US006067771A

United States Patent [19]

Blankenship

[11] Patent Number: 6,067,771

[45] Date of Patent: May 30, 2000

[54] METHOD AND APPARATUS FOR MANUFACTURING MODULAR BUILDING

[76] Inventor: Ralph N. Blankenship, RFD 1, Box 76A, Cedar Bluff, Va. 24609

[21] Appl. No.: 09/135,533

[22] Filed: Aug. 18, 1998

Related U.S. Application Data

[63] Continuation-in-part of application No. 08/375,101, Jan. 19, 1995, abandoned.

[51] Int. Cl.[7] ..... E04G 21/14

[52] U.S. Cl. ..... 52/745.2; 52/745.02

[58] Field of Search ..... 29/897, 897.3, 29/897.31, 897.312, 897.32, 428, 429, 430, 469; 52/745.02, 745.03, 745.19, 745.2

[56] References Cited

U.S. PATENT DOCUMENTS

| | | |
|---|---|---|
| 1,618,886 | 2/1927 | Peterson . |
| 2,604,060 | 7/1952 | Hansen . |
| 2,795,014 | 6/1957 | Kelly . |
| 3,679,177 | 7/1972 | Scholz . |
| 3,762,112 | 10/1973 | Evans et al. . |
| 3,830,025 | 8/1974 | Wainshal . |
| 3,992,848 | 11/1976 | Stucky . |
| 4,003,182 | 1/1977 | Wokas . |
| 4,114,328 | 9/1978 | Lawrence . |
| 4,138,833 | 2/1979 | Townsend . |
| 4,187,659 | 2/1980 | Blachura . |
| 4,281,496 | 8/1981 | Danielsson . |
| 4,450,617 | 5/1984 | Dillon . |
| 4,485,608 | 12/1984 | Kaufman et al. . |
| 4,494,353 | 1/1985 | Lewis . |
| 4,501,098 | 2/1985 | Gregory . |
| 4,513,545 | 4/1985 | Hopkins, Jr. . |
| 4,622,787 | 11/1986 | Scott . |
| 4,884,376 | 12/1989 | Deblock et al. . |
| 5,103,604 | 4/1992 | Teron . |
| 5,173,233 | 12/1992 | Kafarowski . |
| 5,265,384 | 11/1993 | Menke et al. . |
| 5,351,453 | 10/1994 | Leslie . |
| 5,447,752 | 9/1995 | Cobb . |
| 5,575,120 | 11/1996 | Handley . |

FOREIGN PATENT DOCUMENTS

| | | |
|---|---|---|
| 45010 | 1/1974 | Australia . |
| 852465 | 9/1970 | Canada . |
| 2394652 | 2/1979 | France . |

OTHER PUBLICATIONS

American Concrete Institute, Detroit, Michigan, Exhibit 531, 49 pages: 1980.

*Primary Examiner*—Michael Safavi
*Attorney, Agent, or Firm*—Dickstein Shapiro Morin & Oshinsky LLP

[57] ABSTRACT

A modular building is constructed at a module construction area using pre-made component parts that are produced at a component production area. The pre-made component parts are measured, cut and drilled at the component production area and supplied to a module maker at the module construction area so that the module maker assembles the modules without measuring, cutting or drilling the component parts. The module maker uses a plurality of jigs to assemble the modules. The jigs remain attached to the modules during transport to a building site and are removed from the modules prior to the modules being positioned on the foundation.

16 Claims, 8 Drawing Sheets

10

12

14

18
24
26
20
28

16
16
16
32

36

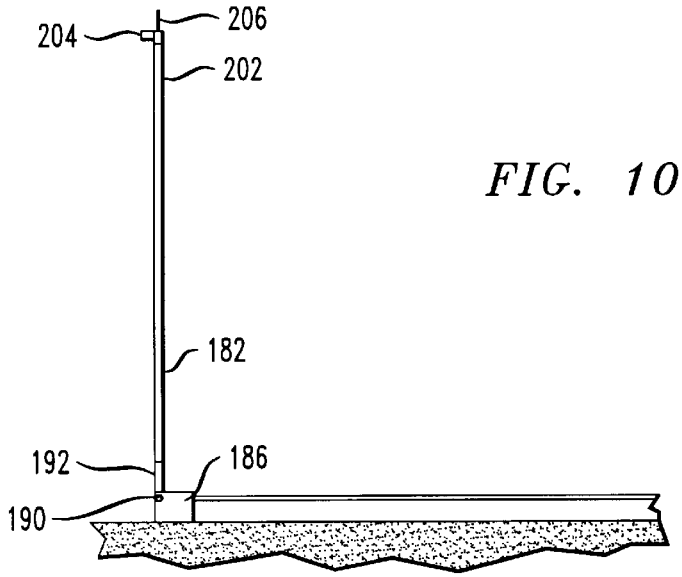
FIG. 10
FIG. 11
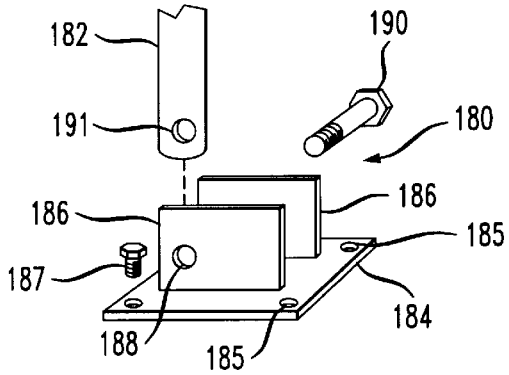
FIG. 12
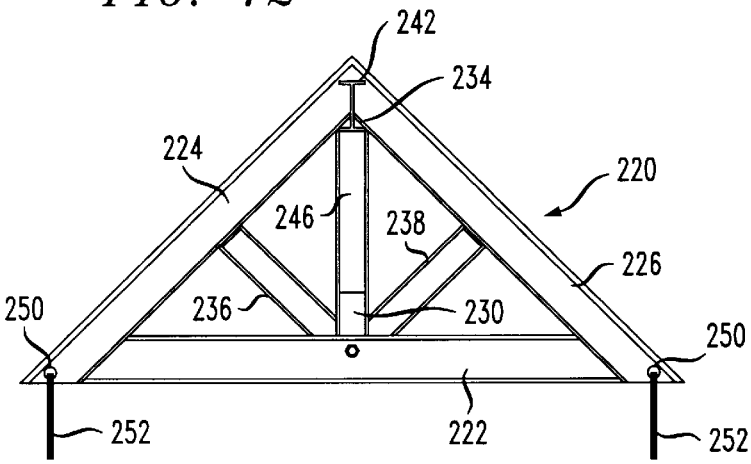

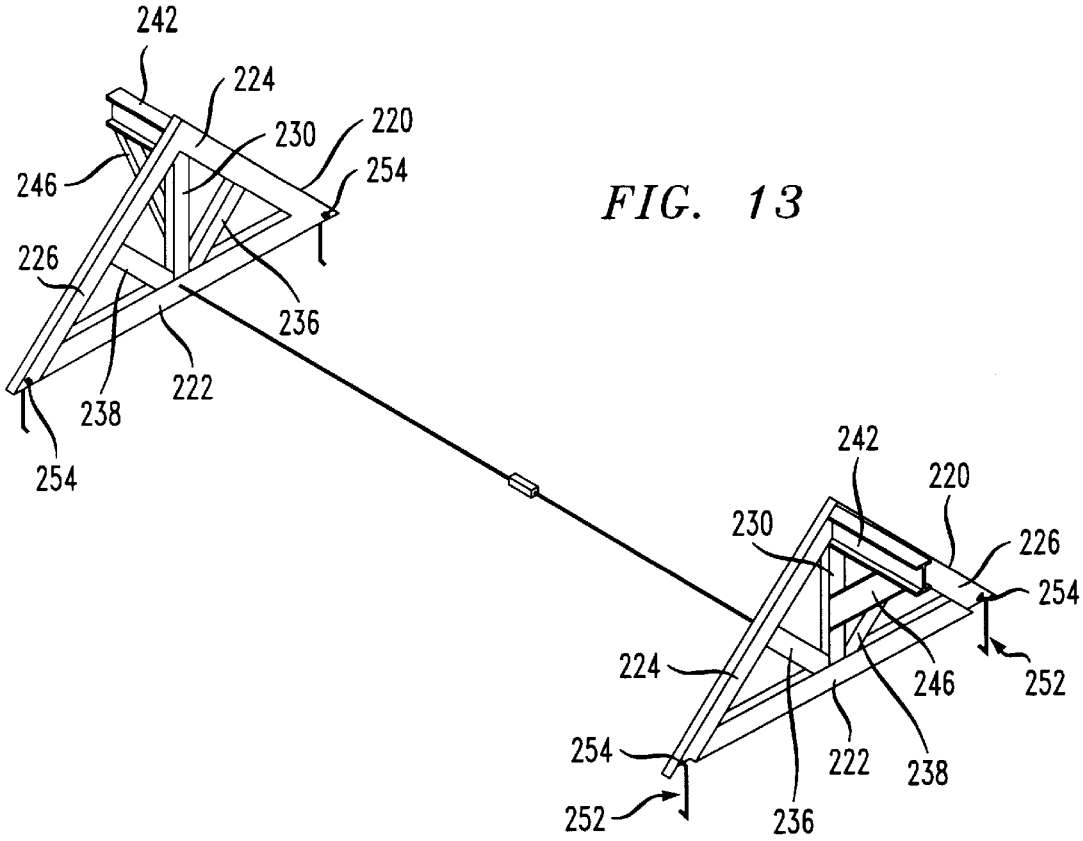
FIG. 13
FIG. 14
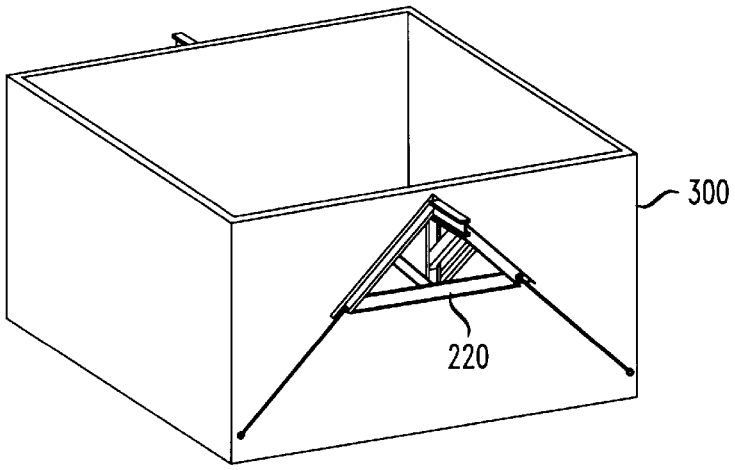

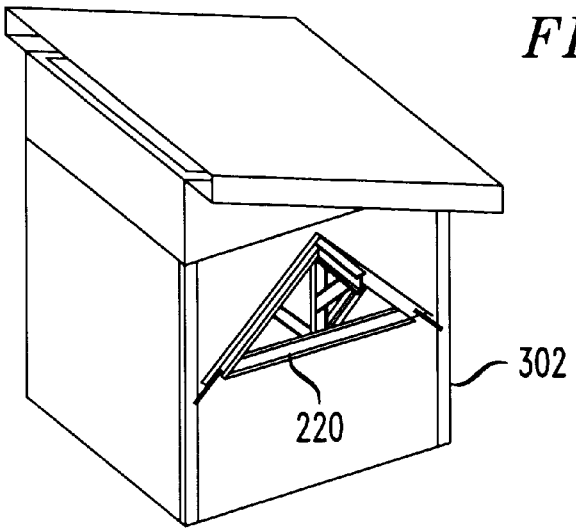
FIG. 15
FIG. 16
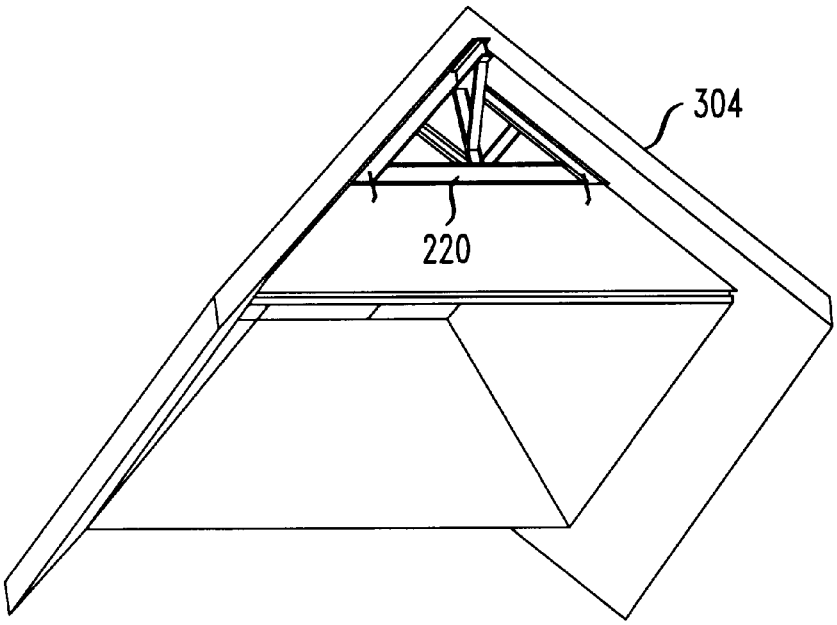

METHOD AND APPARATUS FOR MANUFACTURING MODULAR BUILDING

The present application is a continuation-in-part of U.S. application Ser. No. 08/375,101, filed Jan. 19, 1995, the entire disclosure of which is incorporated herein by reference.

FIELD OF THE INVENTION

This invention relates to a method and apparatus for designing and manufacturing modular buildings. More particularly, the present invention relates to a method and apparatus for efficiently and economically prefabricating modules that can be transported, lifted and placed on an integral construction concrete pad and floor.

BACKGROUND OF THE INVENTION

On-site construction of a house may be prohibitively costly in terms of labor, materials, and time. Accordingly, much effort has been expended to develop prefabricated modules for expedited building construction. These methods have also attempted to maintain the ambiance and character desired by the buyer. Known methods include the construction of entire portions of houses at a remote manufacturing facility. The pre-constructed units are then shipped to the building site and finally assembled in building block fashion.

An example of a conventional construction method is disclosed in U.S. Pat. No. 4,501,098 to Gregory. A portion of a house is constructed off-site in a factory and remaining portions of the house are constructed on-site.

More specifically, a module of the house can be built off-site, transported to the building site, and positioned on a foundation to substantially form a "first level" of the house. Thus, those portions of the house that are "nonexpressive", i.e., which have standard features from floor surface to ceiling, are modularly constructed. The remaining portions of the house are constructed on-site to create enlarged living space areas.

The pre-constructed modules are placed on a foundation, which includes a slab that serves as a floor surface for house portions built on-site. However, the transportation and construction of the modules required non-standardized trailers to accommodate the various types of modules. Since portions must still be custom-constructed on-site, this technique does not substantially reduce the cost of constructing houses or the amount of time required.

The another example is U.S. Pat. No. 4,485,608 to Kaufman, et al. This patent discloses a prefabricated self-contained building and construction method for transporting and lifting building structures in their entirety without the need for providing floors. This is accomplished by fully constructing a floorless building that is lowered by a crane system 21 into position on a slab foundation 23. The slab foundation becomes the floor once the building is placed thereon (see column 4, lines 13–16). However, the transport of a building in its entirety requires a heavy weight trailer, and the load may not conform to VDOT (Vehicle Department of Transportation) size limits 14'×14'×95'. Moreover, a heavy crane is needed to lift the structure in order to load it onto the trailer and lower it onto the foundation. Further, prefabricating a whole building structure off-site, in its entirety, may not have a cost advantage over constructing a whole building at the building site.

Evans et al., U.S. Pat. No. 3,716,112, discloses a steel modular building arranged in a J-plan. According to Evans, a bedroom module, a utility core module, and a living room module are prefabricated in a factory or the like. The module includes a steel frame construction. Each module is made by constructing wall, floor, and roof frames, assembling the frames into a module, and welding the frames together. The prefabricated modules are then transported to the home site. Since Evans includes the roof frames, transportation of the modules requires a heavy weight trailer, and the load may not conform to the VDOT size limits. In addition, Evans discloses moving the modules between spaced apart building stations in the factory. Such movement between stations requires heavy equipment and wastes time.

U.S. Pat. No. 4,513,545 to Hopkins, Jr. also discloses modular structures. Hopkins discloses a structure that is formed by stacking modules. Hopkins discloses apparatus and method for constructing two-story dwellings or offices in which "core modules" are prefabricated and transported to a site and a remainder of the dwelling is completed using additional "wall elements" and other on-site labor techniques. Thus, Hopkins requires extensive on-site labor. U.S. Pat. No. 4,003,182 to Wokus discloses a method of building construction wherein factory built room forming boxes are set in place on a foundation. After the boxes are set in place, the structure is built up around the boxes using the boxes as a core. Thus, the Wokus method requires extensive on-site labor. U.S. Pat. No. 5,353,453 to Leslie discloses a rapidly erectable housing unit. Each unit is constructed from non-uniform wall sections and roof sections. The wall sections and roof sections are joined on-site to form the basic structure. Thus, Leslie, like Hopkins and Wokus, requires extensive on-site labor.

U.S. Pat. No. 2,604,060 to Hanson discloses a roof structure for use with prefabricated houses. Hanson's prefabricated roof structure folds into a compact package for transportation to a construction site. Once at the construction site, the structure is unfolded and connected to several other similar structures to form a roof. Like Hopkins, Wokus, and Leslie, Hanson's roof structure requires substantial on-site labor.

SUMMARY OF THE INVENTION

The present invention overcomes these disadvantages and others by providing a method and apparatus for efficiently designing and manufacturing modular buildings. Component parts are pre-made by being measured, cut, drilled etc., using jigs, at a component production area of a factory. The pre-made component parts are then delivered to a module construction area. The modules are constructed using jigs to align and assemble the pre-made component parts at the module construction area. Thus, module makers construct the modules without measuring, cutting, or drilling the component parts. The modules are completely assembled at the factory and transported to a building site on light weight trailers using the same jigs used to construct the modules. A relatively small crane moves the modules from the trailers to a concrete pad at the building site.

The invention provides a method wherein component parts for modules, for a home or the like, are pre-cut using jigs that act as templates. The modules are assembled at the factory, using the pre-cut component parts, and transported to the building site. The completed modules are assembled into different configurations on top of slab foundation/floors at the building site. Importantly, the modules are assembled using pre-measured, pre-cut, and pre-drilled lumber, and the component parts are assembled into modules by module makers at the factory without the need for individual measuring, cutting or drilling. The same jigs that are used as templates for assembling the modules at the factory remain attached to the modules during transportation to ensure that the modules remain square and plumb during transportation.

BRIEF DESCRIPTION OF THE DRAWINGS

FIG. 10 illustrates a ridge component leveling and aligning jig.

FIG. 11 illustrates a retaining bracket of the ridge component leveling and aligning jig of FIG. 10.

FIG. 12 illustrates a universal lift jig for use in moving modules from the factory floor to a trailer and from the trailer to a foundation at the building site.

FIG. 13 is a perspective view of two universal lift jigs coupled together for lifting a completed module.

FIG. 14 illustrates a universal lift jig coupled to a room module.

FIG. 15 illustrates a universal lift jig coupled to a closet module.

FIG. 16 illustrates a universal lift jig coupled to a roof module.

DETAILED DESCRIPTION OF THE DRAWINGS

Figures 1A, 1B, 1C, 1D, 1E, 1F, 1G, 1H, 1I:
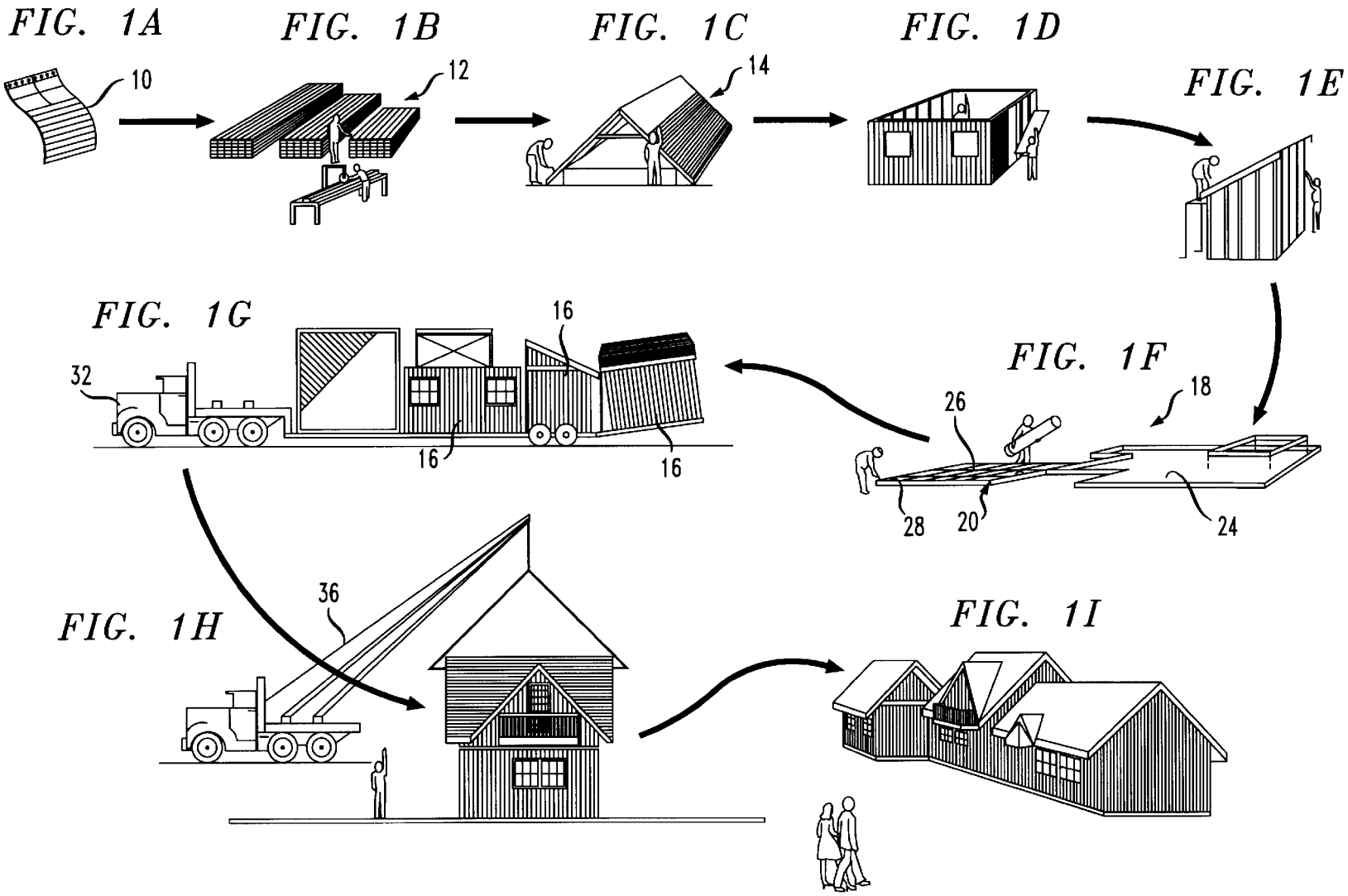
FIG. 1 is a flow diagram showing the process of constructing a modular building in accordance with the present invention.

FIG. 1 illustrates an overview of the process for manufacturing modular buildings in accordance with the present invention. In particular, the starting point in a modular assembly method is the receipt of an order placed by a customer for a modular building, as illustrated in FIG. 1(*a*). A work order 10 is produced and given to plant production personnel at a component production area 12, as illustrated in FIG. 1(*b*). At the component production area 12, plant production personnel pre-make module component parts by measuring, cutting, and drilling raw material from inventory using various jigs. Once measured, cut, and drilled, the pre-made component parts needed to build a particular module are delivered to a module construction area 14 (FIGS. 1(*c*)–1(*e*)).

Alternatively, components having various predetermined sizes may be pre-made and stocked in inventory prior to receiving an order, thereby providing even greater speed and efficiency.

The pre-made components are supplied to module makers at the module construction area 14. Importantly, module makers do not measure, drill or cut any component parts for use in building the module, since the components have already been pre-made in the component production area 12. Instead, module construction only involves the assembly of components into modules 16 using jigs that are specially made for each module 16. Although a roof section module is illustrated in FIG. 1(*c*) and a room module is illustrated in FIG. 1(*d*), the invention is not limited to any particular module type. Instead, reference number 16, as used herein, refers to any module constructed in accordance with the present invention.

All modules 16 are substantially completed by assembly of roofing, insulation, windows, doors, trim, wiring, paint or stain, light fixtures, and drywall, as illustrated giving FIGS. 1(*d*)–1(*e*). Thus, all modules 16 are finished at the factory and are ready to attach to an appropriate foundation, or to other modules 16, at a building site 18.

At the building site 18, a monolithic concrete pad 20 is prepared using modular forms 24, as illustrated in FIG. 1(*f*). The concrete pad 20 is color-mixed in a concrete plant and poured on-site. The pad 20 is polished very smoothly, with grooves 26 formed in the surface to contrast with the pad 20 color. Thus, the pad 20 can serve as the floor of the modular structure. Alternatively, a floor covering can be added to the pad 20, as is conventionally known. Before the concrete pad 20 is dry, attaching bolts 28 are placed into the pad 20 at precise points to provide a fastening mechanism for attaching the module 16 to the pad 20. As illustrated in FIG. 1(*g*), prefabricated modules 16 are transported to the site 18 using the same jigs (FIGS. 3–5 and 9–10) used to make the module 16. The modules 16 are attached to specially made light trailers 32 for transport from the factory to the building site 18. The jigs keep the modules 16 square and plumb during transit and provide a connection mechanism for attaching the modules 16 to trailers 32. These loads are prepared to conform to VDOT size limits (14'×14'×95'). Loads are light in weight (3–5 tons) requiring only small tow units.

As trailer loads arrive at the building site 18 (FIG. 1(*g*)), a small (30') crane 36 places the modules 16 on the prepared concrete pad 20, as illustrated in FIG. 1(*h*). The construction jigs are removed and the module walls are bolted to the concrete pad 20 using bolts 28. Shingles are woven together and the module walls are attached to walls of adjacent modules 16. Sheet rock is taped and painted, and the structure is completed, as illustrated in FIG. 1(*i*). The construction jigs (to be described in more detail below) are returned to the factory.

Figure 2:
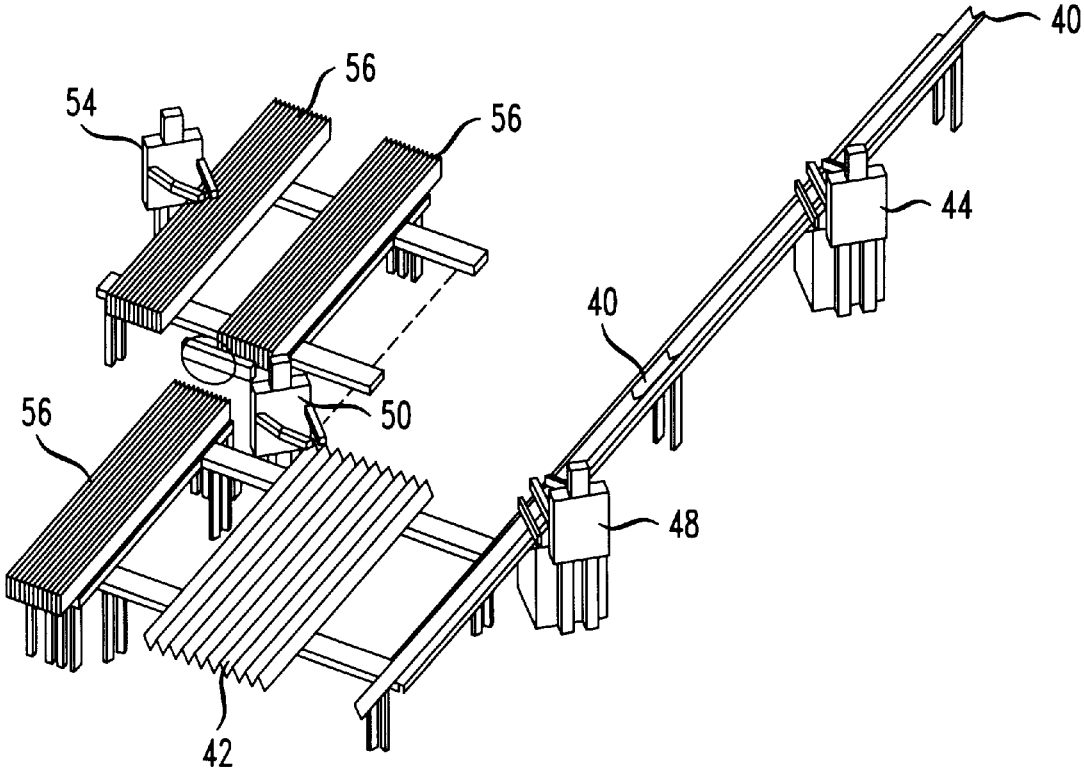
FIG. 2 illustrates a component production area of FIG. 1.

FIG. 2 illustrates a component production area 12 where plant production personnel measure, cut, and drill the component parts used to build various modules 16. These pre-made components are then supplied to a module construction area 14 or to inventory, as desired.

As illustrated in FIG. 2, a 2×8 framing unit 40 from raw material inventory is supplied to a component production area 12 to be made into a rafter 42. A first worker 44 makes a first cut and the framing unit 40 proceeds to a second worker 48. The second worker 48 makes a second, diagonal cut to the framing unit 40, which is then forwarded to a third worker 50. The third worker 50 makes a birdsmouth cut on the framing unit 40 and gathers the finished rafters 42 together. A fourth worker 54 numbers the rafters 42 and removes groups 56 of rafters 42 to a module construction area 14 or to inventory. Other component production areas 12 provide other components, such as pre-cut siding panels, sheet rock panels, pre-hung doors and windows, shingles, insulation, and all other components needed for module construction. As these pre-made, numbered components are produced, they are placed in inventory until ordered, or they are sent to a module construction area 14.

Figure 3:
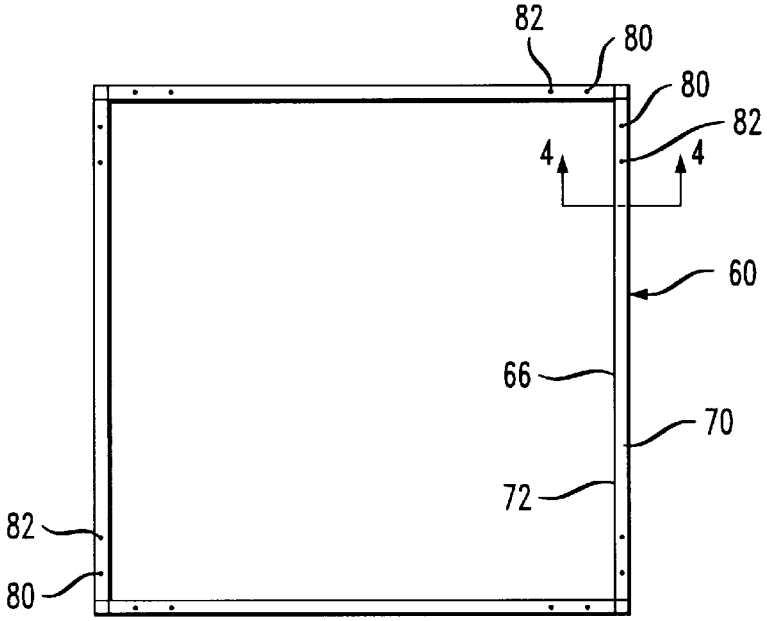
FIG. 3 illustrates a sole plate jig for use in assembling a module in accordance with the present invention.
Figure 4:
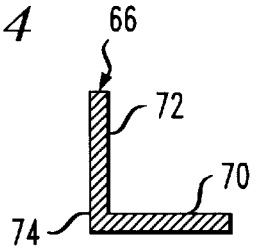
FIG. 4 is a cross section through the sole plate jig taken along line 4—4 of FIG. 3.
Figure 5:
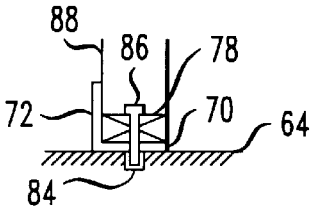
FIG. 5 illustrates a bolt holding a sole plate to the sole plate jig and the sole plate jig to the factory floor.

At the module construction area 14, plant production personnel initially position a sole plate jig 60 on the factory floor 64 and attach it thereto. As illustrated in FIGS. 3–5, the sole plate jig 60 includes a plurality of L-shaped members 66 attached to each other to form a square or other shape that is sized to match the dimensions of the desired module 16. Each L-shaped member 66 includes a horizontal base plate 70 and a vertical wall 72 that extends upwardly from the inside edge 74 of the horizontal base plate 70. The L-shaped members 66 are attached to each other so that the vertical walls 72 cooperate to define an inner perimeter of the module, with the base plates 70 lying outside the vertical walls 72.

Each horizontal base plate 70 has a length equal to one dimension of the desired module 16, and a width equal to be width of a sole plate 78 for a wall of the module 16, typically 3⅝ inches for a 2×4 sole plate. Each base plate 70 further includes a pair of ½ inch diameter holes 80, 82 spaced apart from each end. The holes 80, 82 receive a bolt 86 (FIG. 6) for attaching the sole plate 78 and the jig 60 to the factory floor 64, as illustrated in FIG. 5. The bolt 86 extends through the sole plate 78 and the base plate 70 to engage an expansion plug 84. The vertical walls 72 extend above the sole plate 78 disposed on the base plate 70 to assist in the proper placement of studs 88 on the sole plate 78.

Figure 6:
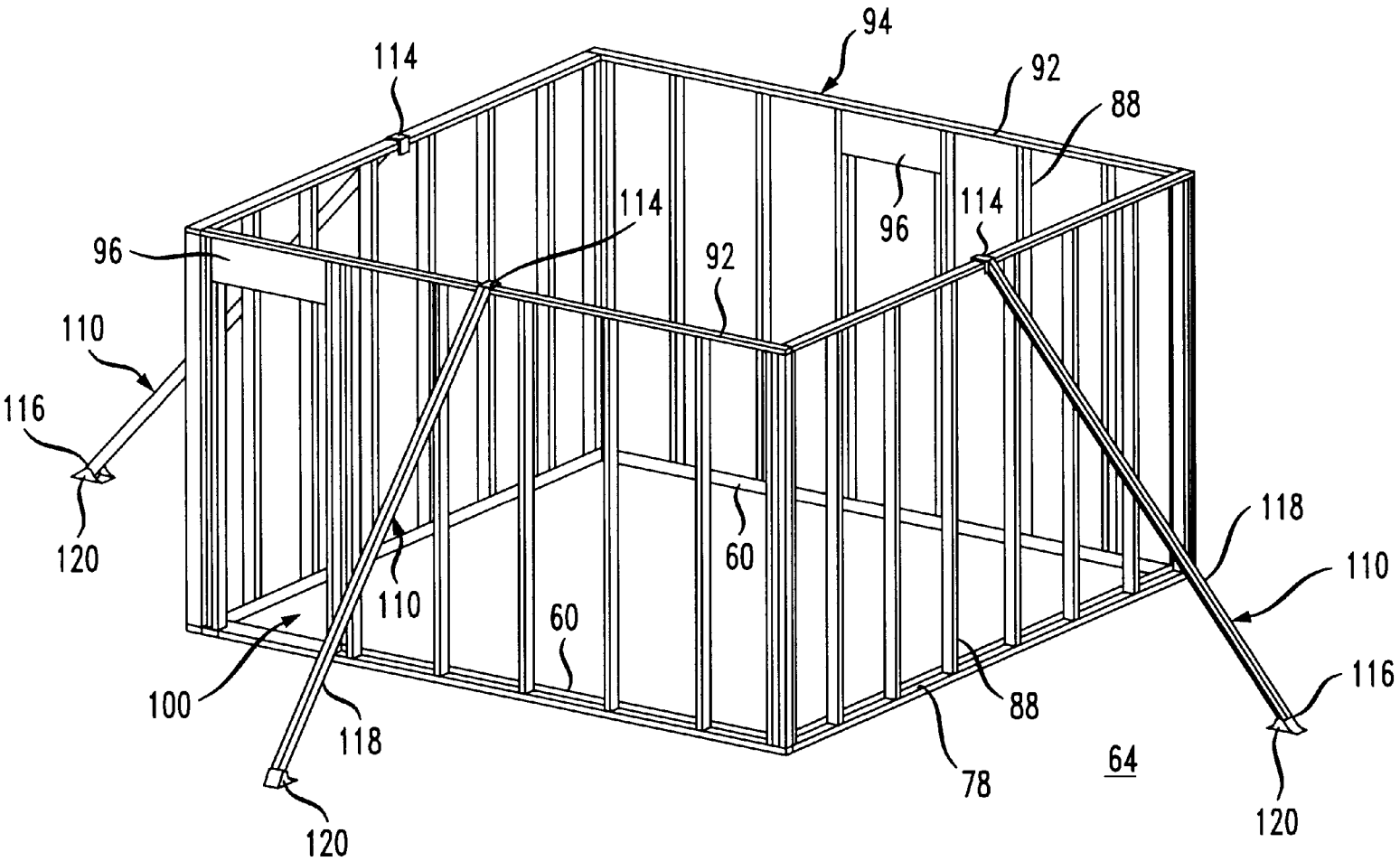
FIG. 6 illustrates the construction of a room module using a sole plate jig and a plumbing jig.

After placement of the sole plate jig 60, the construction of the module 16 continues in a generally conventional manner, as illustrated in FIG. 6. That is, a plurality of lower sole plates 78 are attached to the sole plate jig 60, a plurality of studs 88 are attached to the lower sole plates 78, and a plurality of the upper sole plates 92 are attached to the studs 88 to form walls 94. As required for the particular module 16, headers 96 can be provided in the walls 94 to define and support door openings 100 and window openings (not shown).

Figure 7:
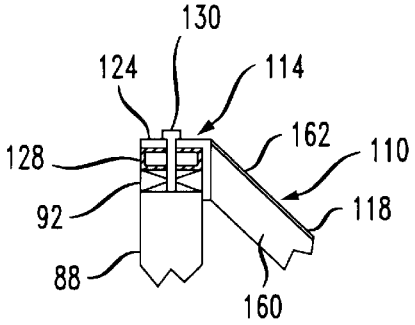
FIG. 7 illustrates a first end of the plumbing jig of FIG. 6.

When the walls 94 are roughed in, as illustrated in FIG. 6, a plumbing jig 110 is attached to each roughed in wall 94 and to the factory floor 64. The plumbing jigs 110 cooperate with the sole plate jig 60 to ensure that the entire module 16 is square and plumb. The plumbing jig 110, illustrated in FIGS. 6–7, includes a first end 114, a second end 116, and a strut 118 extending between the first and second ends 114, 116. The first end 114 is attached to the upper sole plate 92 of a roughed in wall 94 and the second end 116 is attached to a floor mounting bracket 120 (FIG. 8) that is attached to the factory floor 64. As illustrated in FIG. 7, the first end 114 of the plumbing jig 110 includes an L-shaped bracket 124. A 3½"×1½" spacer 128 is disposed in the L-shaped bracket 124, with the spacer 128 configured to rest on top of the upper sole plate 92 of the module wall 94. The L-shaped bracket 124 and the spacer 128 are preferably bolted to the upper sole plate 92 by bolt 130.

Figure 8:
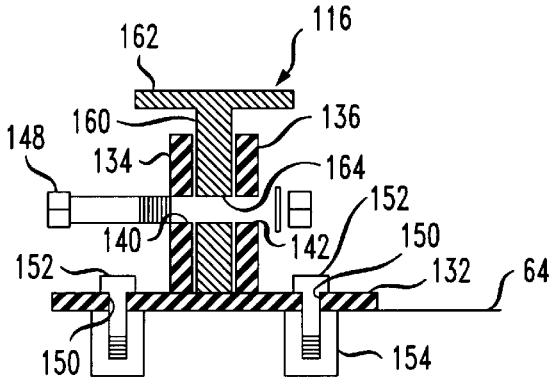
FIG. 8 is a section view taken through a floor-mounting bracket for attaching the plumbing jig of FIG. 6 to the factory floor.

As illustrated in FIG. 8, the second end 116 of the plumbing jig 110 is attached to the factory floor 64 by the floor mounting bracket 120. The floor mounting bracket 120 includes a base plate 132 and two vertical plates 134, 136 extending upwardly, in space-apart relation, from the base plate 132. The vertical plates 134, 136 include aligned holes 140, 142 for receiving a retaining bolt 148 for attaching the second end 116 of the plumbing jig 110 to the floor mounting bracket 120. The base plate 132 includes a plurality of bolt-receiving holes 150 for attaching the base plate 132 to the factory floor 64. When the floor mounting bracket 120 is properly positioned on the factory floor 64, bolts 152 are passed through the bolt-receiving holes 150 and into expansion plugs 154 formed in the factory floor 64.

The strut 118 includes a pair of perpendicular members 160, 162 welded to each other, with a first member 160 depending downwardly from the center of a second member 162. Both ends of the first member 160 are cut inwardly at a 45 degree angle so that when the first end 114 of the strut 118 is welded to the inverted L-shaped bracket 124, it extends downwardly at a 45 degree angle. The second end 116 of the strut 118 includes a bolt-receiving hole 164 formed in the first member 160 that is aligned with the holes 140, 142 formed in the vertical plates 134, 136 of the floor mounting bracket 120. When the strut 118 is properly aligned with the floor mounting bracket 120, the bolt 148 is passed through the bolt-receiving holes 140, 142, 164 in the vertical plates 134, 136 and the first member 160, respectively.

Figure 9:
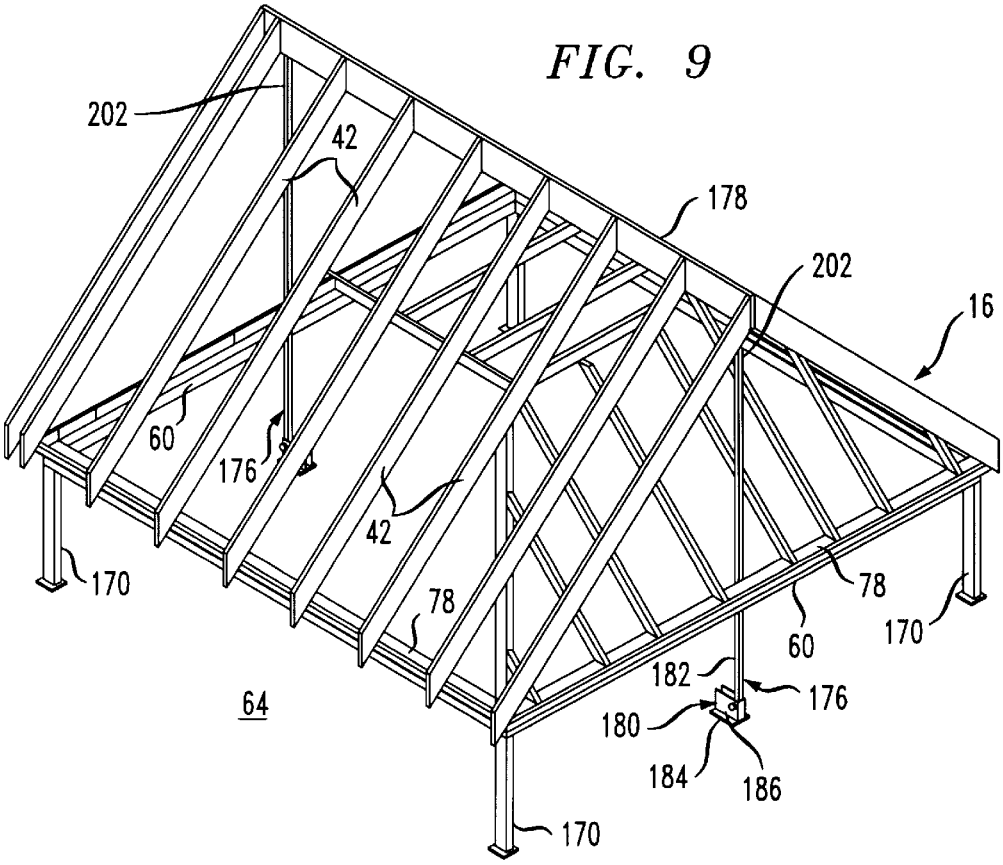
FIG. 9 illustrates a partially completed roof module being constructed in accordance with the present invention.

FIG. 9 illustrates the construction of a roof module 16 in accordance with the present invention.

Construction of a roof module 16 begins by rigidly attaching a plurality of legs 170 to the factory floor 64. A sole plate jig 60 is then attached to the legs 170. Advantageously, the legs provide one of the unique features of the present invention by raising the entire roof module about three feet above the factory floor 64, thereby allowing workers access to the inside of the module 16 during construction.

The roof module uses a sole plate jig 60 that is substantially identical to the sole plate jig 60 used to make the room module that is intended to be covered by the roof module. The use of identical sole plate jigs 60 ensures that the roof exactly matches the room module dimensionally and that the finished module and roof are completely square and plumb.

Another unique feature of the present invention includes a ridge component leveling and aligning jig 176. The ridge component leveling and aligning jig 176 is rotatably attached to the factory floor 64 and positioned to align the ridge component 178 relative to the sole plate jig 60. As illustrated in FIGS. 9–10, the ridge component leveling and aligning jig 176 includes a retaining bracket 180 and a pole 182. The retaining bracket 180 includes a base plate 184 and pair of parallel plates 186 extending upwardly from the base plate 184. The plates 186 each include a hole 188 for receiving a pole-retaining bolt 190. The base plate 184 includes a plurality of bolt-receiving holes 185. A plurality of bolts 187 attaches the base plate 184 to the factory floor 64, as previously described with respect to the sole plate jig 60.

The pole 182 includes a first end 192 having a transverse hole 191 aligned with the holes 188 in parallel plates 186. The retaining bolt 190 is passed through the plate holes 188 and the transverse hole 191 to retain the pole 182 in the bracket 180 for movement between a horizontal position and a vertical position. A second end 202 of the pole 182 includes a leveler portion 204 that extends horizontally from the top of the pole 182, and beam insert pin 206 that extends upwardly from the top of the pole 182 along the longitudinal axis of the pole 182. The beam insert pin 206 is sized to fit into a pre-drilled hole in the ridge component 178 to align the ridge component 178 with the sole plate jig 60. The leveler portion 204 is positioned to abut the bottom of the ridge component 178 and retain the ridge component 178 at the proper elevation above the sole plate jig 60 when the pin 206 is fitted in the pre-drilled hole in the ridge component 178.

Once the legs 170, sole plate jig 60, and ridge component leveling and aligning jig 176 are properly installed, the roof module 16 is constructed in an otherwise conventional manner. That is, sole plates 78 are attached to the sole plate jig 60, the ridge component 178 is installed on the ridge component leveling and aligning jig 176, and rafters 42 are installed to extend between the ridge component 178 and the sole plates 78. Sub-roofing and shingles are added over the rafters 42.

FIGS. 11–12 illustrates a universal lift jig 220 for use in lifting the modules 16 from the factory floor 64 onto a trailer 32 and from the trailer 32 to the pad 20 at the building site 18. The lift jig 220 includes a base member 222 and a pair of opposed members 224, 226 disposed to form a triangle. A vertical support member 230 extends from the apex 234 of the triangle to the center of the base member 222 of the triangle. A pair of diagonal support members 236, 238 extend from the junction of the vertical support member 230 and the base member 222 of the triangle to the opposing sides 224, 226, respectively, of the triangle. A cantilever I-beam 242 extends outwardly from the apex 234 of the triangle. A cantilever support member 246 angles downwardly from the cantilever I-beam 242 to the vertical support member 230 to support the cantilever I-beam 242.

The base member 222 of the triangle includes a hole 250 at each end. A C-shaped lift member 252 is rotatably coupled to each of the holes 250. Each of the C-shaped lift members 252 includes a first portion 254 that is inserted into one of the holes 250. A retainer 258 retains the first portion 254 in the hole 250. An intermediate portion 260 depends downwardly from the first portion 254 and joins a third portion 262. The third portion 262 extends from the intermediate portion 260 in the same direction as the first portion 254 and is configured to engage holes formed in the modules 16. Various sizes of C-shaped lift couplers 252 can be used, depending on the module 16 to be lifted, as illustrated in FIGS. 13–15.

As illustrated in FIG. 12, the universal lift jigs 220 work in pairs. A cable 268 is attached to each lift jig 220 at the center of the base member 222, and a turnbuckle 270 adjustably couples the lift jigs 220 together. FIGS. 13–15 illustrate universal lift jigs 220 coupled to different modules 16. The module 16 illustrated in FIG. 13 is a room module 300, such as a living room, dining room, bedroom, or the like. FIG. 14 illustrates the universal lift jig 220 coupled to a typical closet module 302, while FIG. 15 illustrates the universal lift jig 220 coupled to a typical roof module 304.

While the invention has been described in detail in connection with preferred embodiments known at the time, it should be readily understood that the invention is not limited to such disclosed embodiments. Rather, the invention can be modified to incorporate any number of variations, alterations, substitutions or equivalent arrangements, not heretofore described, that are commensurate with the spirit and scope of the invention.

What is claimed as new and desired to be protected by Letters Patent of the United States is:

1. A method for manufacturing a modular building comprising the steps of:

receiving an order to build a structure;

preparing components based on said order, said components including wooden studs;

supplying said components to at least one module construction area;

assembling, by use of a sole plate jig for each module, said components into a plurality of modules including non-uniform room modules and roof section modules, said modules being formed with wooden frames without measuring or cutting said components at said module construction area, so that said modules are substantially completed, said modules requiring no additional on-site elements other than paint and spackle;

transporting said plurality of modules to said home site;

removing said sole plate jig of each module; and lowering and attaching said plurality of modules onto a monolithic concrete pad or other of said plurality of modules.

2. The method of manufacturing a modular building according to claim 1, wherein said step of transporting is done with a trailer designed to load said modules, said trailers supporting loads up to a weight of about five tons.

3. The method of manufacturing a modular building according to claim 1 wherein said concrete pad is color mixed and polished, and grooves are formed on said concrete pad to contrast with a color of said concrete pad.

4. The method for manufacturing a modular building according to claim 1, wherein said components further include drywall, insulation, windows, doors and electrical wiring.

5. A method for manufacturing a building comprising steps of:

receiving an order to build a building;

selecting components according to said order, said components including wooden studs;

assembling, by use of a sole plate jig for each module, said components into a plurality of modules including non-uniform room modules and roof section modules, said modules being formed with wooden frames without measuring or cutting said components at said module making station, so that said modules are substantially completed, said modules requiring no additional on-site elements other than paint and spackle;

putting a monolithic concrete pad on a home site using modular forms;

placing a plurality of attaching bolts in said monolithic concrete pad at precise points;

transporting said plurality of modules to said home site;

removing said sole plate jig of each module; and lowering and attaching said plurality of modules on said monolithic concrete pad or other of said plurality of modules.

6. The method of manufacturing a modular building according to claim 5, wherein said concrete pad is color mixed and polished, and grooves are formed on said concrete pad to contrast with a color of said concrete pad.

7. The method of manufacturing a modular building according to claim 5, wherein the step of transporting is done with a trailer designed to load such modules, said trailer supporting loads up to a weight of about five tons.

8. The method for manufacturing a modular building according to claim 5, wherein said components further include drywall, insulation, windows, doors and electrical wiring.

9. A method for manufacturing modular buildings comprising the steps of:

receiving an order to build a home;

preparing components based on said order, said components including wooden studs;

supplying said components to at least one module construction area; and assembling, by use of a sole plate jig for each module, said components into a plurality of modules including non-uniform room modules and roof section modules, said modules being formed with wooden frames without measuring or cutting said components at said module making station, so that said modules are substantially completed, said modules requiring no additional non-site elements other than paint and spackle;

transporting said plurality of modules to a home site; and removing said sole plate jig of each module.

10. A method for manufacturing modular buildings comprising the steps of:

receiving an order to build a building;

selecting components according to said the order, said components including wooden studs;

supplying said components to at least one module making station; and assembling, by use of a sole plate jig for each module, said components into a plurality of modules including non-uniform room modules and roof section modules, said modules being formed with wooden frames without measuring or cutting said components at said module making station, so that said modules are substantially completed, said modules requiring no additional on-site elements other than paint and spackle;

transporting said plurality of modules to a home site; and removing said sole plate jig of each module.

11. A method of building a modular building comprising the steps of:

providing a first sole plate jig;

building a room module using the first sole plate jig as a template;

providing a second sole plate jig;

building a roof module using the second sole plate jig as a template, the first sole plate jig being substantially identical to the second sole plate jig;

transporting the completed modules to a building site with their respective sole plate jigs attached; and removing said respective sole plate jigs.

12. The method of claim 11 further including the step of providing a ridge component jig, the step of building the roof module including the step of using the ridge component jig to position a ridge component relative to the second sole plate jig.

13. The method of claim 11 further including the step of providing a plumbing jig, the sole plate jig and the plumbing jig cooperating to ensure that the room module is square and plumb.

14. The method of claim 13 wherein the plumbing jig includes a first end configured to engage a wall of the room module and a second end configured to be coupled to a floor.

15. The method of claim 11 further comprising the step of removing the respective sole plate jigs prior to installing the roof module on the room module.

16. The method of claim 15 wherein the step of removing the respective sole plate jigs includes the step of removing the first sole plate jig from the room module prior to placing the room module on a foundation.

* * * * *